US006558269B1

(12) United States Patent
McBee

(10) Patent No.: US 6,558,269 B1
(45) Date of Patent: May 6, 2003

(54) METHOD AND DEVICE IMPLEMENTING A CUSTOM FIT PUTTER

(75) Inventor: DuWayne McBee, Porter, TX (US)

(73) Assignee: McBee Golf Company, Porter, TX (US)

( * ) Notice: Subject to any disclaimer, the term of this patent is extended or adjusted under 35 U.S.C. 154(b) by 0 days.

(21) Appl. No.: 09/359,189

(22) Filed: Jul. 22, 1999

(51) Int. Cl.[7] ..... A63B 53/06
(52) U.S. Cl. ..... 473/248; 473/340
(58) Field of Search ..... 473/244–248, 473/296, 334–339, 340–41, 313, 288

(56) References Cited

U.S. PATENT DOCUMENTS

| | | | | | |
|---|---|---|---|---|---|
| 3,102,726 | A | | 9/1963 | Barrett | |
| 3,333,854 | A | | 8/1967 | White | |
| 3,368,812 | A | | 2/1968 | Baldwin | |
| 3,891,212 | A | | 6/1975 | Hill | |
| 4,121,832 | A | | 10/1978 | Ebbing | |
| 4,618,149 | A | | 10/1986 | Maxel | |
| 4,884,808 | A | | 12/1989 | Retzer | |
| 5,116,047 | A | | 5/1992 | Phelan et al. | |
| 5,253,869 | A | | 10/1993 | Dingle et al. | |
| 5,348,295 | A | | 9/1994 | Phillips | |
| 5,407,196 | A | | 4/1995 | Busnardo | |
| 5,429,356 | A | | 7/1995 | Dingle et al. | |
| 5,437,447 | A | | 8/1995 | Rigutto | |
| 5,441,274 | A | * | 8/1995 | Clay | 273/187.5 |
| 5,462,279 | A | | 10/1995 | Culpepper | |
| 5,513,844 | A | | 5/1996 | Ashcraft et al. | |
| 5,533,730 | A | | 7/1996 | Ruvang | |
| 5,542,665 | A | | 8/1996 | Levocz et al. | |
| 5,569,096 | A | * | 10/1996 | Lee | 473/248 |
| 5,577,726 | A | | 11/1996 | Fenton | |
| 5,597,362 | A | | 1/1997 | Lee et al. | |
| 5,603,666 | A | | 2/1997 | Bowe | |
| 5,692,969 | A | | 12/1997 | Schooler | |
| 5,709,613 | A | | 1/1998 | Sheraw | |
| 5,716,287 | A | * | 2/1998 | Levocz et al. | 473/248 |
| 5,733,203 | A | | 3/1998 | Middleton | |
| 5,749,790 | A | | 5/1998 | Van Alen, II et al. | |
| 5,769,737 | A | * | 6/1998 | Holladay et al. | 473/336 |
| 5,795,239 | A | | 8/1998 | Lin | |
| 5,803,824 | A | | 9/1998 | Rollingson | |
| 5,816,931 | A | | 10/1998 | Schooler | |
| 5,997,412 | A | * | 12/1999 | Benson | 473/296 |
| 6,142,884 | A | * | 11/2000 | Yim | 473/248 |
| 6,149,533 | A | * | 11/2000 | Finn | 473/336 |

* cited by examiner

*Primary Examiner*—Steven Wong
(74) *Attorney, Agent, or Firm*—Shook, Hardy & Bacon LLP

(57) ABSTRACT

A custom fit putter kit having an adjustable length shaft, an adjustable putter head lie angle and an adjustable weight. The shaft feature includes two sections which are connected and whose overall length is controlled by utilizing spacers of different lengths. The adjustable putter head lie angle feature utilizes a four pre-bored hole, two locking pin method of providing three potential putter head lie angles. The weight adjustment feature includes a central cavity and a weight plug which is utilized for different lengths of shaft to improve the continuum of the swing. Interrelated, the three variable features are utilized in conjunction to conform to physiology and swing style of the specific user. Thus, the present invention provides an inexpensive, custom fit putter with no need for additional tools or the individual use of harsh chemicals.

17 Claims, 2 Drawing Sheets

Fig. 6.
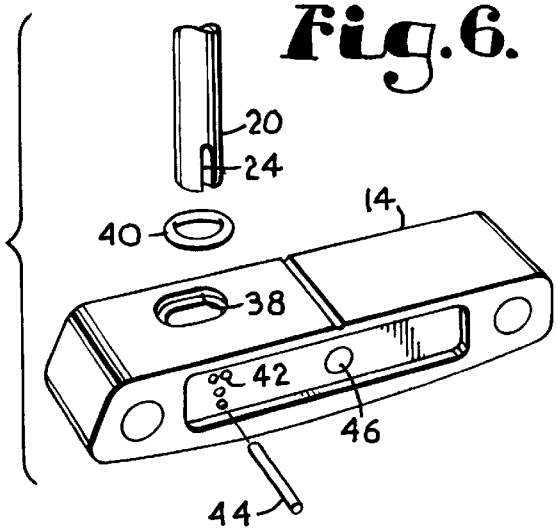
Fig. 8.
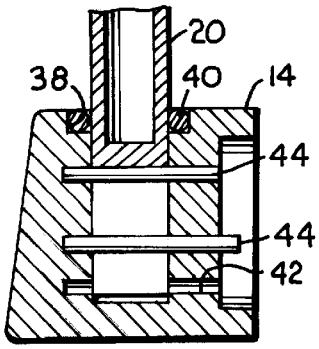
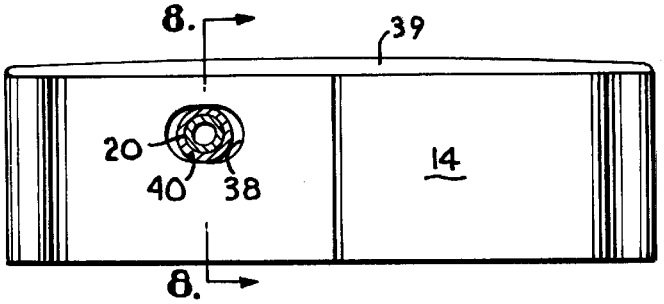
Fig. 7.
Fig. 9.
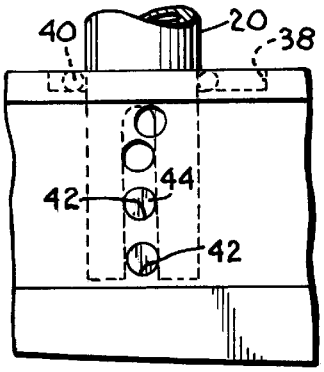
Fig. 10.
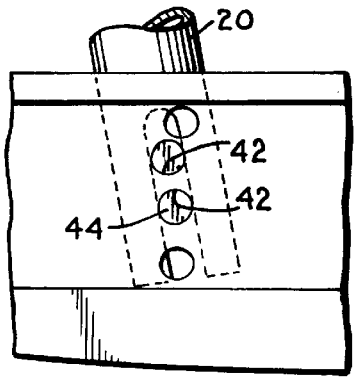

METHOD AND DEVICE IMPLEMENTING A CUSTOM FIT PUTTER

BACKGROUND OF THE INVENTION

1. Field of the Invention

In general, this invention relates to a custom fit golf club and more specifically, to a multi-element custom fit putter utilizing a variable shaft length, a variable weight and a variable putter head lie to conform to the physiology and style of a specific user.

2. Description of the Related Art

The sport of golfing is very individualized, depending completely on a combination of the individual skill and physiology of the player. Although two players may have comparable skills, the techniques implemented by each player may be quite different. For example, irrespective of the level of skill of the player, a tall player has a different swing than the shorter player, based solely on the physiology of the player. Additionally, players often incorporate different styles of swings to improve aspects of their golf game. Because each player may implement a different style of swing, a golf club that can adjust for variances in the physiology of the player and can address stylistic preferences is highly desirable. Thus, a golf club kit, and in particular, a custom fit putter kit, which implements an adjustable putter is beneficial to a player wishing to improve his or her putting.

In general, the prior art discloses custom putters in which the length of the putter shaft is adjustable. However, in these prior art devices, the length of the shaft must be adjusted using specialized tools. Accordingly, a consumer wishing to adjust the length of a putter shaft must purchase the specialized tools and have the facilities in which to use them appropriately. Additionally, because the putter shaft is typically fixed to the putter head or contains the mounting means necessary to attach the shaft to the putter head, the shaft length of the prior art custom fit putters must be adjusted at the grip end, requiring the removal and reattachment of the grip. The chemicals required to remove and re-affix the grip are unsuitable for use in the home, office or motel room. Thus, because of the impracticality of purchasing special tools or using unsafe chemicals, the typical consumer must rely on a made-to-order manufacturer to customize the length of the putter shaft.

In a similar fashion, other prior art custom putters allow a consumer to designate a specific lie angle, designated generally as the angle between the putter shaft and the horizontal plane of the putter head when ordering a putter. Although these prior art putters implement an adjustable putter head lie, the lie angle of the prior art custom putters is fixed upon its manufacture and cannot be adjusted by the typical consumer after receiving the putter.

Based on these two prior art deficiencies, a consumer who is uncertain of what length shaft or putter head lie angle to order cannot typically experiment with different lengths and angles before ordering. This eliminates the practicality of a custom fit putter to a large group of consumers.

Some prior art putter kits have attempted to address this deficiency by implementing user adjustable custom fit putter kits. The majority of these prior art devices disclose a golf putter in which the lie angle is adjusted utilizing a variety of pivoting and locking structures such as screws and locking pins. Additionally, other prior art devices disclose a putter in which the relative length of the shaft is adjusted by either adding an extension to lengthen the shaft to reach the armpit of the user or by adjusting the relative distance between the shaft and the head of the putter to "lengthen" the overall shaft length.

As a matter of practical and commercial viability, however, any adjustable putter must comply with the rules and regulations set forth by golfing regulatory bodies such as the PGA and LPGA. Such regulations require that the shaft angle relative to the putter head face must be at a minimum of 10 degrees from vertical and that the putter cannot be adjusted or be capable of being adjusted throughout a match. Thus, many of the adjustable prior art patents disclosing methods of varying shaft length or especially putter head lie angle, such as an angle adjusting screw mechanism, do not conform to the regulations on adjustable clubs. Although every user would not be subject to these regulations, it appears that a majority of consumers who would consider purchasing a custom fit putter would typically want that putter to conform to the regulations of the golfing industry. Additionally, as a matter of courtesy one would typically not enjoy playing with a player who seeks an unfair advantage by using non-regulation equipment.

Although some of the prior art patents have addressed the needs of ensuring that the custom putter complies with the golfing industry regulations on adjustable putters, none of the prior art discloses a system which incorporates an adjustable length shaft, an adjustable putter head lie and an adjustable weight. A true custom fit putter must account for variances in both the angle of the putter head and the length of the shaft. Additionally, as the length of the shaft varies, the overall weight of the club must also be varied to ensure the proper continuum of the swinging motion, an essential trait in putting. The existing prior art devices typically allow a user to vary only one of these three factors and do not incorporate a systematic, cost-effective method of providing a custom fit putter designed to conform to the needs of each user.

There exists a need for a custom fit putter which can be adjusted by the user without requiring expensive and bulky rudimentary tools. Further, there exists a need for a custom fit putter which incorporates a true adjustable length shaft, an adjustable putter head lie and an adjustable putter weight. Finally, there exists a need for a custom fit putter kit which allows a user to vary the shaft length, putter head lie, and weight in conjunction with multi-element putter assembly.

SUMMARY OF THE INVENTION

Based on the above-mentioned deficiencies in the prior art, it is an object of the present invention to provide a custom fit putter that is inexpensive and does not require additional specialized tools or the use of dangerous chemicals.

It is a further object of the present invention to provide a custom fit putter which has a true adjustable length shaft, an adjustable putter head lie and an adjustable weight.

Finally, it is an object of the present invention to provide a custom fit putter kit which incorporates a variable shaft length, a variable putter head lie and a variable weight in combination to provide a complete custom fit putter based on the physiology and style of the individual player.

These and other objects of the present invention are achieved as a method and device implementing a custom fit putter. A putter of the present invention is constructed of two primary sections. The first section, the shaft, includes a tip end piece and grip end piece which are connected together. The second section, the head, includes a single piece having multiple openings for interfacing with various structures. In general, the interconnecting of the two sections of the present invention creates a golf putter that is optimized for the specific physiology and swing characteristics of the individual player.

The shaft section of the present invention includes two primary pieces which are bonded together. The first piece, the tip end piece, is a shaft of a fixed length which is typically hollow and constructed of aluminum, graphite, or other suitable materials. As would be understood, the tip end piece can alternatively be a solid or semi-solid shaft. The tip end piece gradually narrows at one end such that the diameter of the narrower end is smaller than the diameter of the wider end. In the preferred embodiment, the narrow end of the tip end piece contains a lock pin slot for use in construction of the completed custom fit putter. In other embodiments, the lock pin slot is replaced by a lock pin hole, but both structures retain the same function.

The second piece, the grip end piece, is also constructed of a single piece which is constructed of the same material as the tip end piece. The grip end piece includes a first portion which is of the same width as the wide end of the tip end piece and a second portion with is narrower. At the wide end, a grip is preaffixed to the shaft eliminating any need for the consumer to have to remove the grip to adjust the club. The narrow end of the grip end piece is of a smaller diameter such that it fits within the wide portion of the tip end piece.

To construct the full shaft, the narrow end of the grip end piece is inserted into the wide end of the tip end piece. Therefore, the shortest shaft length possible includes only the length of the tip end piece and the grip end piece. To lengthen the shaft, a plurality of spacers of various lengths are inserted on the narrow end of the grip end piece in between the two pieces of the shaft. Accordingly, being offered a variety to spacers to be used singularly or in combination, a consumer can vary the cumulative shaft length. In the preferred embodiment, once the appropriate length of the shaft is selected, the consumer permanently fixes the length utilizing an epoxy submitted in the kit, which is safe to use in most areas, especially the home, office or motel room.

The shaft section and the putter head section are joined together via a two-lock pin assembly. To join the two sections together, the narrow end of the tip end piece is inserted into a corresponding shaft access hole in the top putter head section. The shaft access hole is typically of an oval type shape which allows the shaft to move longitudinally, but restricts any movement about an axis perpendicular to the longitudinal axis. To further ensure a proper fit and to seal the shaft access hole, an o-ring seals the shaft at the point of contact with the putter head.

Once the shaft section has been inserted into the putter head, the angle the shaft makes with the longitudinal axis of the putter head, the lie angle, is fixed. To compensate for different player preference of lie angle, the putter head presents four prebored lock pin holes for fixing the lie angle of the putter head. To fix the lie angle, a first locking pin is inserted into a common hole which creates a pivoting pin. Next, a second locking pin is inserted into one of a plurality of holes which have been specifically prebored to create several lie angles with respect to the common hole. In the preferred embodiment, the putter head contains three prebored holes to give the consumer a choice of 69 degrees, 72 degrees or 75 degrees putter head lie angle from horizontal. As would be understood, different putter head lie angles would be considered within the scope of the present invention. After the appropriate putter head lie angle has been selected, the locking pin is fixed by the application of the epoxy.

The present invention also varies the weight of the golf club dependant on the changes to the length of the shaft. In the preferred embodiment, the weight of the putter has been selected to match the longest length of the shaft possible. In the event that the consumer wishes to shorten the length of the shaft, the weight of the putter should be increased to ensure a proper balance. Accordingly, the present invention includes a central cavity within the putter head that allows a weight plug to be inserted to increase the overall weight of the club. As would be understood, a different weight plug could be implemented for each specific length of a shaft, or a weight plug could be utilized for ranges of shaft length. Similar to the other variable features, the weight plug is fixed to the putter head with an epoxy.

Although each step has been described as an independent feature, the present invention is also aimed at a method of constructing a custom fit putter in which the three features, adjustable length shaft, adjustable putter head lie angle and adjustable putter head weight, are utilized in conjunction with one another to allow a player to meet the demands of the player's specific physiology and skill. For example, a tall player with shorter arms would likely use the longest shaft possible with an upright lie angle to make for a smoother swing. Likewise, a shorter player with longer arms would utilize a short shaft length with a low lie angle. Because each player has a different physiology and because each player utilizes a different swing, the present invention allows the player to construct his or her own personalized putter without incurring a high cost, without requiring the use of a made-to-order manufacturer, and without using dangerous chemicals.

BRIEF DESCRIPTION OF THE DRAWINGS

Objects and features of the invention denoted above are explained in more detail with reference to the drawings, and in which like reference numerals are used to indicate like parts in the various views:

FIG. 6 is an exploded perspective view of the present invention;

FIG. 7 is a top plan view of the putter head of the present invention;

FIG. 8 is a sectional view of the assembly of the present invention;

FIG. 9 is an enlarged elevational view of the putter head lie angle adjustment mechanism of the present invention; and FIG. 10 is an enlarged elevational view of the putter head lie angle adjustment mechanism of the present invention.

DETAILED DESCRIPTION OF THE PREFERRED EMBODIMENTS

For a better understanding of the present invention, reference may be had to the following detailed description taken in conjunction with the appended claims and accompanying drawings. In essence, the present invention allows a consumer to construct a custom fit putter from a kit which can vary the length of the shaft, the putter head lie angle and the weight of the putter head.

Figure 1:
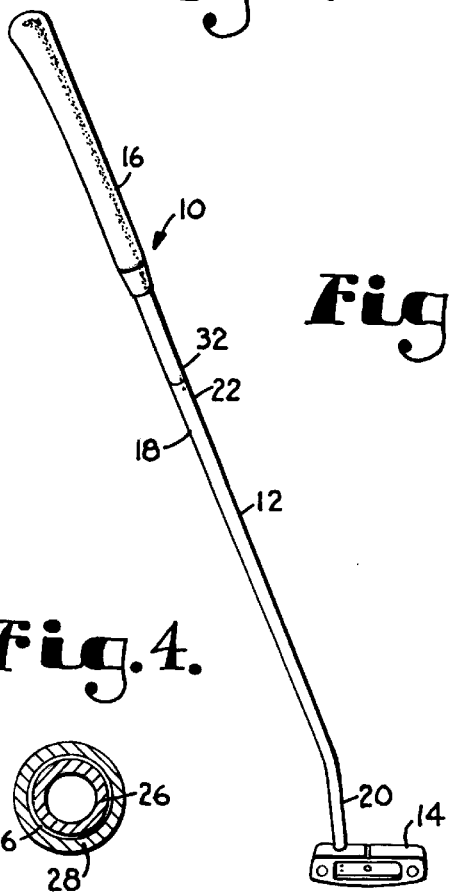
FIG. 1 is perspective view of the present invention.

FIG. 1 is a perspective view of view of the custom fit putter of the present invention, denoted generally by the numeral 10. The custom fit putter 10 includes two sections, the shaft 12 and the putter head 14. Together the two sections form a custom fit putter 10 which has three adjustable structures.

Figure 2:
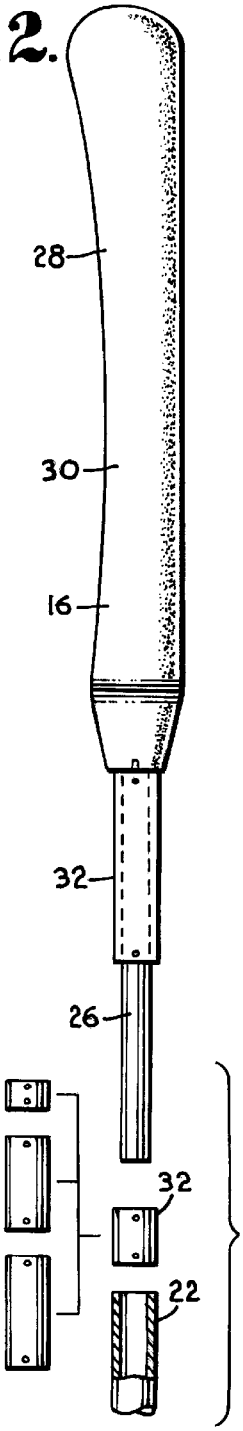
FIG. 2 is an expanded fragmentary exploded view of the shaft of the present invention.
Figure 3:
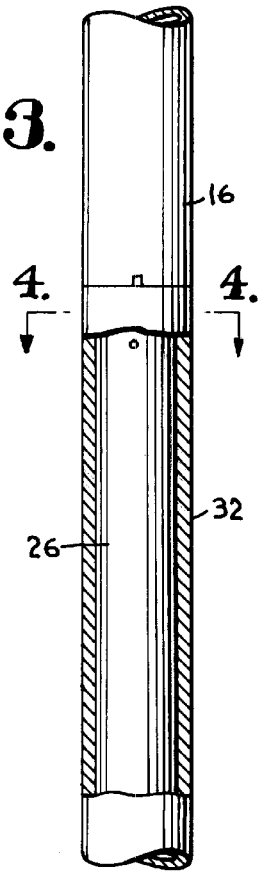
FIG. 3 is an enlarged fragmentary elevational view of the shaft of the present invention.

With specific reference to FIGS. 1, 2, and 3, the shaft section 12 of the custom fit putter 10 includes a grip end piece 16 and a tip end piece 18. The tip end piece 18 is a shaft of a fixed length which is typically hollow and constructed of a material suitable for golf clubs, such as aluminum, graphite, other noncomposite or other composite materials. As would be understood, different shaft materials would be considered within the scope of the present invention. The tip end piece 18 gradually narrows at one end, the narrow end 20, such that narrow end 20 is narrower than the other end of the tip end piece 18, the wide end 22. Narrow end 20 is preferably curved in shaped such that the narrow end 20 is at an angle with respect to wide end 22. In the preferred embodiment, the wide end 22 is 0.600 inches in diameter and the narrow end 20 is 0.375 inches in diameter. As would be understood, different diameters and different ratios of diameters of the ends of the tip end piece 18 would be considered within the scope of the present invention.

As best demonstrated in FIG. 6, the narrow end 20 of the tip end piece 18 has a shaft pin access slot 24. In the preferred embodiment, the shaft pin access slot 24 runs from the base of the shaft 12 and creates a channel through the middle of the shaft 12. In other embodiments, the shaft pin access slot 24 is a bored hole or a plurality of holes.

The grip end piece 16 is a shaft of a fixed length which typically matches the diameter and material of the tip end piece 18. Similar to the tip end piece 18, the grip end piece 16 has a narrow end 26 and a wide end 28. The wide end 28 is a shaft having a grip 30 fixed to the outside of the shaft. The grip 30 is typically not adjustable. The narrow end 26 is of a diameter such that it will fit within the hollow, wide end 22 of the tip end piece 18. In the preferred embodiment, the wide end 28 is 0.600 inches in diameter and 10 inches in length and the narrow end 26 is 0.500 inches in diameter and 5 inches in length. As would be understood, different dimensions are considered within the scope of the present invention.

Figure 4:
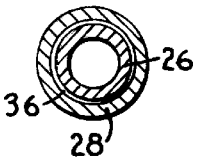
FIG. 4 is a sectional view of the shaft of the present invention.

As best demonstrated in FIGS. 2, 3, and 4, the shaft 12 of the present invention is constructed by the joining of the grip end piece 16 with the tip end piece 18. To construct the shortest possible shaft 12, the narrow end 26 of the grip end piece 16 is inserted into wide end 22 of the tip end piece 18 such that both wide end pieces 22, 28 contact each other. Because each of the two pieces are of a fixed length, the shaft length is at its minimum length. In a first embodiment, the grip end piece 16 is 10 inches long and the tip end piece 18 is 20 inches, making the minimum shaft length 30 inches. In a second embodiment, the tip end piece 18 is 23.5 inches in length, making the minimum shaft length 33.5 inches. In the preferred embodiment, the kit of the present invention includes both length tip end pieces 18 to provide a consumer with a range of shaft lengths from 30 inches to 36.5 inches. As would be understood, different length pieces are considered within the scope of the present invention.

To add length to the shaft 12, a plurality of spacers 32 are inserted in the narrow end 26 of grip end piece 16 such that they do not allow the wide end 22 of the tip end piece 18 to contact the narrow end 26 of the grip end piece 16. The spacers 32 are of the same diameter and material as the two other shaft pieces, and can be used singularly or in conjunction with one another. In the preferred embodiment, the spacers 32 come in 3.0 inch, 2.5 inch, 2.0 inch, 1.5 inch, 1.0 inch and 0.5 inch lengths. As would be understood, different length spacers 32 would be considered within the scope of the present invention.

With specific reference to FIGS. 2 and 4, once the appropriate spacer(s) 32 is selected to construct the shaft 12 of the desired length, the pieces of the shaft 12 are fixed. To fix the pieces, a consumer aligns the marking dots 34 of each shaft to ensure that the shafts are properly connected. Upon aligning the shaft pieces, the consumer applies epoxy 36 to all the pieces. In the preferred embodiment, epoxy 36 is not toxic and is safe to use in the home, office or abroad while still providing sufficient bonding to fix the pieces of the shaft 12. As seen in the FIG. 4, the narrow end 26 of the grip end piece 16 fits within the wide end 22 of the tip end piece 18. A layer of epoxy 36 bonds the two pieces together. As would be understood, different methods of bonding the pieces together would be considered within the scope of the present invention.

Figure 5:
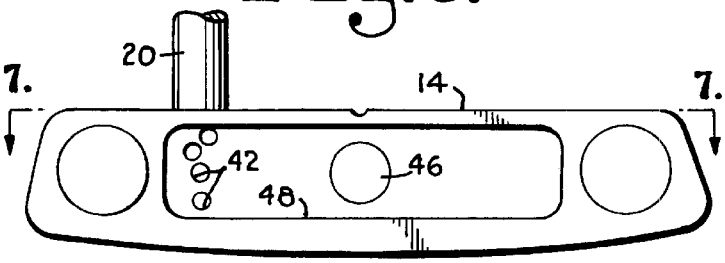
FIG. 5 is an enlarged fragmentary rear elevational view of the present invention.

FIGS. 5, 6 and 9 are representative of the preferred embodiment of putter head 14. Putter head 14 is preferably constructed of aluminum, graphite or any other material typically used in the manufacture of golf club heads. In the preferred embodiment, putter head 14 is of a generally rectangular shape, having a face 39 at a 4 degree loft angle. Putter head 14 is also preferably 4.500 inches in length, 0.937 inches in width and 1.125 inches in height.

FIGS. 5, 6 and 7 demonstrate the joining of the two sections of the putter 10. To join the two sections of the putter 10, the tip end piece 18 of the shaft 12 is inserted into the shaft access hole 38. In the preferred embodiment, the shaft access hole 38 is of an oval shape, with respective diameters of 0.465 inches and 0.375 inches, which allows the shaft 12 to move along the longitudinal axis of the putter head 14. At the same time, the oval shape of the shaft access hole 38 prevents the movement of the shaft 12 in an axis perpendicular to the longitudinal axis. An o-ring 40 ensures a proper seal and fit between the shaft 12 and the putter head 14.

Upon insertion into the putter head 14, the putter head angle of the shaft 12 relative to the horizontal plane of the putter head 14 is fixed. In the preferred embodiment, the custom fit putter 10 provides three preestablished putter head lie angles accomplished by utilizing four prebored holes 42, preferably approximately 0.125 inches by 0.750 inches, and two locking pins 44. As would be understood, the number of preestablished angles or different values of preestablished angles would be considered within the scope of the present invention.

With specific reference to FIG. 6, the shaft 12 is inserted into the shaft access hole 38 and a first locking pin 44 is inserted through the prebored hole 42 and through the lock pin slot 24. As would be understood, the first prebored hole 42 is a common hole and the first locking pin 44 creates a pivoting point with the shaft 12. To fix the putter head lie angle, a second locking pin 44 is placed through one of the three remaining prebored holes 42 and the lock pin slot 24, thereby preventing the shaft 12 from any further movement.

In the preferred embodiment, the three remaining prebored holes 42 are machined such that the produce a putter head lie angle of 69 degrees, 72 degrees and 75 degrees respectively. To accomplish the preferred putter head lie angles, holes 42 are 0.982, 1.011 and 1.000 inches from center respectively from top to bottom. In this embodiment, the bottom two holes 42 are 1.000 inches from center. In combination with the curved shape of tip end piece 18, holes 42 correspond to standard, flat and up putter head lie angles. FIGS. 8, 9, and 10 demonstrate how the two locking pins pass through the prebored holes 42 and the lock pin slot 24 to produce different angles. As would be understood, different values of the putter head lie angle would be considered within the scope of the present invention.

The putter head 14 is premilled at a weight that is optimized for the longest possible length of the shaft 12. Because the shaft length 12 is variable, as the shaft 12 is shortened, the weight of the putter head 14 will no longer be optimized. To compensate for shorter length shaft 12, a weight plug 46 is inserted into a central cavity 48 within putter head 14. Preferably, central cavity 48 is located at the center of the putter head 14 and is 0.500 inches in diameter. The increase in the weight of the club allows for a smoother swing continuum for shorter length shafts 12. In the preferred embodiment, a single weight plug 46 compensates for a range of shaft lengths. However, in an alternative embodiment, a plurality of weight plugs 46 are utilized to balance the putter head weight for each potential shaft length 12. Additional weight plugs 46 are inserted into weight cavities 48, which are preferably 1.687 inches from center and 0.750 inches in diameter. Once the appropriate weight plug 46 is inserted into the cavity 48, the weight is fixed to the putter head 14 by the application of an epoxy.

The custom fit putter 10 of the present invention is a system for constructing a putter in which the shaft length, putter head lie angle and weight are adjusted based on the physiology and style of the individual player. By utilizing simple construction procedures that do not require additional tools or harsh, toxic chemicals, the custom fit putter of the present invention provides a user with an inexpensive putter that conforms to his or her personal traits. Accordingly, the present invention is envisioned a system which varies the shaft length, putter head lie angle and weight as a total process for developing a custom putter for each player.

The invention is considered to have been described in such full, clear, concise and exact terms as to enable a person of ordinary skill in the art to make and use the same. It will be apparent to those skilled in the art, that a person understanding this invention may conceive of changes or other embodiments or variations, which utilize the principles of this invention without departing from the broader spirit and scope of the invention as set forth in the appended claims. All are considered within the sphere, spirit and scope of the invention. The specification and drawings are, therefore, to be regarded in an illustrative rather than restrictive sense. Accordingly, it is not intended that the invention be limited except as may be necessary in view of the appended claims or their equivalents, which particularly point out and distinctly claim the subject matter applicant regards as its invention.

I claim:

1. A custom fit golf club, said custom fit golf club comprising:

a multiple piece adjustable length shaft having first and second ends, said first end having a slot defined therein, said slot extending from said first end to a point between said first and second ends of said shaft;

a putter head, wherein said putter head has a top surface, a front surface and a back surface, said putter head having a plurality of lie adjustment holes formed in said back surface defining fixed angle positions for adjusting a putter head lie angle; and at least two locking pins, wherein said first end of said multiple piece shaft is mounted in said top surface of said putter head, and wherein said putter head lie angle measured from said shaft relative to a horizontal plane of said putter head, and wherein said locking pins are inserted in said lie adjustment holes and said slot to fix said putter head lie angle, and wherein at least one of said locking pins protrudes outwardly from said back surface of said putter head at a distance into an external environment to facilitate removal of said locking pin from said lie adjustment hole and said slot.

2. The custom fit golf club of claim 1, wherein said putter head contains a weight cavity defined in about the center of said back surface of said putter head, and wherein a weight plug is inserted into said weight cavity to adjust a weight of said custom fit golf club.

3. The custom fit golf club of claim 1, wherein said plurality of lie adjustment holes allow for three fixed putter head lie angles.

4. The custom fit golf club of claim 3, wherein said three fixed angles comprise substantially 69 degrees, 72 degrees and 75 degrees.

5. The custom fit golf club of claim 1, wherein said multiple piece shaft comprises:

a grip piece;

a tip piece; and a plurality of spacers, wherein said shaft is constructed by inserting said grip piece into said tip piece and wherein said spacers are utilized in between said grip piece and said tip piece to vary an overall length of said shaft.

6. The custom fit golf club of claim 5, wherein said grip piece comprises a wide end having a grip preaffixed to said piece and a narrow end, wherein said narrow end is typically circular and of a radius such that it fits within a opening within said tip piece.

7. The custom fit golf club of claim 5, wherein said tip piece comprises:

a wide end, said wide end being generally circular; and a narrow end, said narrow end being generally circular and of a radius generally smaller than a radius of said wide end.

8. The custom fit golf club of claim 7, wherein said wide end includes an opening, said opening for accepting said grip end.

9. The custom fit golf club of claim 7, wherein said narrow end includes said slot.

10. The custom fit golf club of claim 1, wherein said multiple piece shaft and said putter head lie angle are fixed by applying a fixing agent.

11. A custom fit golf club, said custom fit golf club comprising:

a grip, said grip mounted on a shaft, said shaft being generally circular;

a spacer, said spacer being generally circular;

a tip, said tip being generally circular and having first and second ends, said first end having a slot defined therein, said slot extending from said first end to a point between said first and second ends of said shaft; and a putter head, said putter head having a top surface with an access hole defined therein, a front surface, a bottom surface, and a back surface, wherein a plurality of lie adjustment holes are formed in said back surface;

wherein said grip, said spacer and said tip interconnect fixedly with one another to form a shaft, and wherein said first end of said tip is inserted into said access hole in said top surface of said putter head, wherein said shaft is maintained at a putter head lie angle measured with respective to a longitudinal plane of said putter head and said shaft, and wherein said putter head lie angle is fixed by inserting a pair of locking pins through said lie adjustment holes within said putter head and said slot, and wherein at least one of said locking pins protrudes outwardly from said back surface of said putter head at a distance into an external environment to facilitate removal of said locking pin from said lie adjustment hole and said slot.

12. The custom fit putter of claim 11, wherein the putter head further comprises a weight balancing means defined in about the center of said back surface of said putter head, said means for increasing the weight of the of the club dependant on an overall length of said combination.

13. The custom fit putter of claim 11, wherein said spacer comprises a plurality of individual spacers, each said individual spacer of different lengths.

14. The custom fit putter of claim 11, wherein said putter head includes a plurality of lie adjustment holes formed in said back surface for fixing said putter head lie angle.

15. The custom fit putter of claim 14, wherein said putter head angle and said combination are fixed by applying a fixing agent.

16. The custom fit putter of claim 15, wherein said fixing agent is an epoxy.

17. A kit for creating a custom fit golf club, said kit comprising:

a multiple piece adjustable length shaft including at least one generally circular spacer and a circular tip having first and second ends, wherein said spacer is coupled with said second end of said tip, and wherein a slot is defined in said tip and extends from said first end of said tip to a point between said first and second ends of said tip;

a grip mounted on said second end of said tip of said shaft;

a putter head having a top surface, a front surface and a back surface, said putter head having a plurality of lie adjustment holes formed in said back surface defining fixed angle positions for adjusting a putter head lie angle, said top surface having an access hole defined therein, and said putter head having a cavity formed in about the center of said back surface;

at least two locking pins; and a weight plug;

wherein said first end of said tip is inserted into said access hole in said top surface of said putter head, wherein said weight plug is inserted into said cavity to adjust the weight of the custom fit golf club, wherein said putter head lie angle measured from said shaft relative to a horizontal plane of said putter head, wherein said locking pins are inserted in said lie adjustment holes and said slot to fix said putter head lie angle, and wherein at least one of said locking pins protrudes outwardly from said back surface of said putter head at a distance into an external environment to facilitate removal of said locking pin from said lie adjustment hole and said slot.

* * * * *

UNITED STATES PATENT AND TRADEMARK OFFICE

CERTIFICATE OF CORRECTION

PATENT NO. : 6,558,269 B1
DATED : May 6, 2003
INVENTOR(S) : Devine

It is certified that error appears in the above-identified patent and that said Letters Patent is hereby corrected as shown below:

Title page,
Item [57], ABSTRACT,
Line 6, please cancel “pre-bored” and replace with -- prebored --.

Column 3,
Line 63, please cancel “preb-” and replace with -- pre- --.
Line 64, please cancel “ored” and replace with -- bored --.
Line 64, please cancel “69 degrees, 72 degrees or 75 degrees” and replace with -- a 69-degree, 72-degree or 75-degree --.

Column 5,
Line 6, please cancel “of view”.
Line 23, please cancel “shaped” and replace with -- shape --.

Column 6,
Line 31, please cancel “4 degree” and replace with -- 4-degree --.
Line 65, please cancel “preb-” and replace with -- pre- --.
Line 66, please cancel “ored” and replace with -- bored --.
Line 66, please cancel “the” and replace with -- they --.

Column 7,
Line 39, after the word “envisioned”, please insert the word -- as --.

Column 9,
Line 6, please cancel “respective” and replace with -- respect --.
Line 18, please cancel “of the of the” and replace with -- of the --.

Signed and Sealed this

Twenty-third Day of September, 2003

JAMES E. ROGAN
*Director of the United States Patent and Trademark Office*